US012565293B1

(12) United States Patent
Schacht et al.

(10) Patent No.: US 12,565,293 B1
(45) Date of Patent: Mar. 3, 2026

(54) HINGE ASSEMBLIES FOR RECONFIGURABLE WATERCRAFT

(71) Applicant: Origami Paddler, Inc., Bellingham, WA (US)

(72) Inventors: Stefan Schacht, Bellingham, WA (US); Timothy A. Niemier, Bellingham, WA (US)

(73) Assignee: Summit Applied Technologies, Inc., Arlington, WA (US)

( * ) Notice: Subject to any disclaimer, the term of this patent is extended or adjusted under 35 U.S.C. 154(b) by 490 days.

(21) Appl. No.: 18/045,719

(22) Filed: Oct. 11, 2022

Related U.S. Application Data

(60) Provisional application No. 63/262,383, filed on Oct. 11, 2021.

(51) Int. Cl.
*B63B 34/23* (2020.01)

(52) U.S. Cl.
CPC ..... *B63B 34/23* (2020.02)

(58) Field of Classification Search
CPC ..... B63B 34/20; B63B 34/21; B63B 34/23
USPC ..... 114/347, 353, 354
See application file for complete search history.

(56) References Cited

U.S. PATENT DOCUMENTS 3,639,933 A * 2/1972 Trowbridge ..... B63B 7/06 114/354
4,366,769 A 1/1983 Lingeman
5,353,733 A * 10/1994 Evans ..... B63B 7/04 114/353
D352,266 S 11/1994 Niemier
D352,689 S 11/1994 Niemier
5,397,525 A 3/1995 Niemier
5,417,179 A 5/1995 Niemier et al.
D364,139 S 11/1995 Niemier
D377,473 S 1/1997 Niemier
5,617,810 A * 4/1997 Sauerwein ..... B63B 7/04 114/353
D390,527 S 2/1998 Niemier
D400,843 S 11/1998 Niemier
(Continued)

FOREIGN PATENT DOCUMENTS

RU 20071331171 A 2/2009

OTHER PUBLICATIONS

International Searching Authority, International Search Report and the Written Opinion, Aug. 12, 2021, 10 pages.

*Primary Examiner* — Daniel V Venne
(74) *Attorney, Agent, or Firm* — Schacht Law Office, Inc.; Michael R. Schacht

(57) ABSTRACT

A hinge assembly for a reconfigurable watercraft having a latch support member, a striker member, a pivot member, and a latch member. The pivot member is arranged such that the striker member may rotate about a pivot axis relative to the latch support member. The latch member is supported by the latch support member for movement along a latch axis between a retracted position and an extended position. When the hinge assembly is in the open configuration and the latch member is in the extended position, the striker member engages the latch member to inhibit movement of the hinge assembly from the open configuration to the closed configuration. When the latch member is in the retracted position, the latch member is disengaged from the striker member such that the hinge assembly may be moved between the open configuration and the closed configuration.

14 Claims, 18 Drawing Sheets

(56) References Cited

U.S. PATENT DOCUMENTS

| | | | | |
|---|---|---|---|---|
| 5,868,097 | A * | 2/1999 | Spickelmire | B63B 7/04 114/353 |
| 5,964,177 | A | 10/1999 | Niemier | |
| 6,152,063 | A | 11/2000 | Niemier | |
| 6,178,912 | B1 | 1/2001 | Niemier | |
| 6,615,762 | B1 | 9/2003 | Scott | |
| 7,347,755 | B1 | 3/2008 | Katzfey | |
| 7,395,773 | B1 | 7/2008 | Finefield | |
| 9,422,029 | B1 | 8/2016 | Niemier et al. | |
| 11,738,831 | B2 | 8/2023 | Niemier | |
| 2008/0246236 | A1 | 10/2008 | Lombano et al. | |
| 2010/0024709 | A1 | 2/2010 | Griffin | |

* cited by examiner

HINGE ASSEMBLIES FOR RECONFIGURABLE WATERCRAFT

RELATED APPLICATIONS

This application, U.S. patent application Ser. No. 18/045,719, filed Oct. 11, 2022, claims benefit of U.S. Provisional Application Ser. No. 63/262,383 filed Oct. 11, 2021, the contents of which are incorporated herein by reference. A copy of the U.S. Provisional Application Ser. No. 63/262,383 is attached hereto as Exhibit A.

TECHNICAL FIELD

This application relates to small watercraft such as kayaks, canoes, row boats, sail boats, and paddle boards and, more particularly, to small watercraft that can be folded for ease of storage and/or transportation.

BACKGROUND

The present invention relates to small watercraft such as kayaks, canoes, row boats, sail boats, and paddle boards that may be folded to obtain a smaller form factor to facilitate storage and/or transportation of the kayak. The present invention is of particular significance when applied to kayaks and paddle boards, and examples of the application of the principles of the present invention will be described herein in the context of a watercraft that can function as a kayak and as a paddle board. The principles of the present invention are, however, more generally applicable to other types of small watercraft such as canoes, row boats, and sail boats. The scope of the present invention should thus be determined with respect to the claims appended hereto and not the following description of several examples of the invention.

Conventional reconfigurable watercraft have not seen a large degree of commercial success because such watercraft have typically lacked the stability, reliability, ease of use and other desirable characteristics of a traditional, one-piece watercraft. Previous reconfigurable watercraft thus exhibit problems that prevented widespread adoption of reconfigurable watercraft.

One purpose of the present invention is to provide a reconfigurable watercraft that provides enhanced stability, reliability, and ease of use.

SUMMARY

The present invention may be embodied as a hinge assembly for use with a reconfigurable watercraft comprising at least first and second watercraft sections. The hinge assembly comprises a latch support member, a striker member, a pivot member, and a latch member. The latch support member is supported by the first watercraft section. The striker member is supported by the second watercraft section. The pivot member is arranged relative to the latch support member and the striker member such that the striker member may rotate about a pivot axis relative to the latch support member to allow the hinge assembly to be arranged in an open configuration and in a closed configuration. The latch member is supported by the latch support member for movement along a latch axis between a retracted position and an extended position. When the hinge assembly is in the open configuration and the latch member is in the extended position, the striker member engages the latch member to inhibit movement of the hinge assembly from the open configuration to the closed configuration. When the latch member is in the retracted position, the latch member is disengaged from the striker member such that the hinge assembly may be moved between the open configuration and the closed configuration.

The present invention may also be embodied as a hinge assembly for use with a reconfigurable watercraft comprising at least first and second watercraft sections, the hinge assembly comprises a latch support assembly, a striker assembly, a pivot assembly, and a latch assembly. The latch support assembly comprises a first latch support member and a second latch support member and is rigidly connected to the first watercraft section. The striker assembly comprises a first striker member and a second striker member and is rigidly connected to the second watercraft section. The pivot assembly comprises a pivot member pivotably connected to the first latch support member and the first striker member such that the striker assembly may rotate about a pivot axis relative to the latch support assembly to allow the hinge assembly to be arranged in an open configuration and in a closed configuration. The latch assembly comprising a latch member and is supported by the latch support assembly such that the latch member is movable along a latch axis between a retracted position and an extended position. When the hinge assembly is in the open configuration and the latch member is in the extended position, the latch member engages the second striker member to inhibit movement of the hinge assembly from the open configuration to the closed configuration. When the latch member is in the retracted position, the latch member is disengaged from the second striker member such that the hinge assembly may be moved between the open configuration and the closed configuration.

The present invention may also be embodied as a method of reconfiguring a watercraft comprising at least first and second watercraft sections, the method comprising the following steps. A latch support assembly comprising a first latch support member and a second latch support member is provided. The latch support assembly is rigidly connected to the first watercraft section. A striker assembly comprising a first striker member and a second striker member is provided. The striker assembly is rigidly connected to the second watercraft section. A pivot assembly comprising a pivot member is provided. The pivot member is arranged to pivotably connect the first latch support member and the first striker member such that the striker assembly may rotate about a pivot axis relative to the latch support assembly to allow the hinge assembly to be arranged in an open configuration and in a closed configuration. A latch assembly comprising a latch member is provided. The latch assembly is supported from the latch support assembly such that the latch member is movable along a latch axis between a retracted position and an extended position. When the hinge assembly is in the open configuration and the latch member is in the extended position, the latch member is caused to engage the second striker member to inhibit movement of the hinge assembly from the open configuration to the closed configuration. When the latch member is in the retracted position, the latch member is disengaged from the second striker member such that the hinge assembly may be moved between the open configuration and the closed configuration.

DETAILED DESCRIPTION

Figure 1:
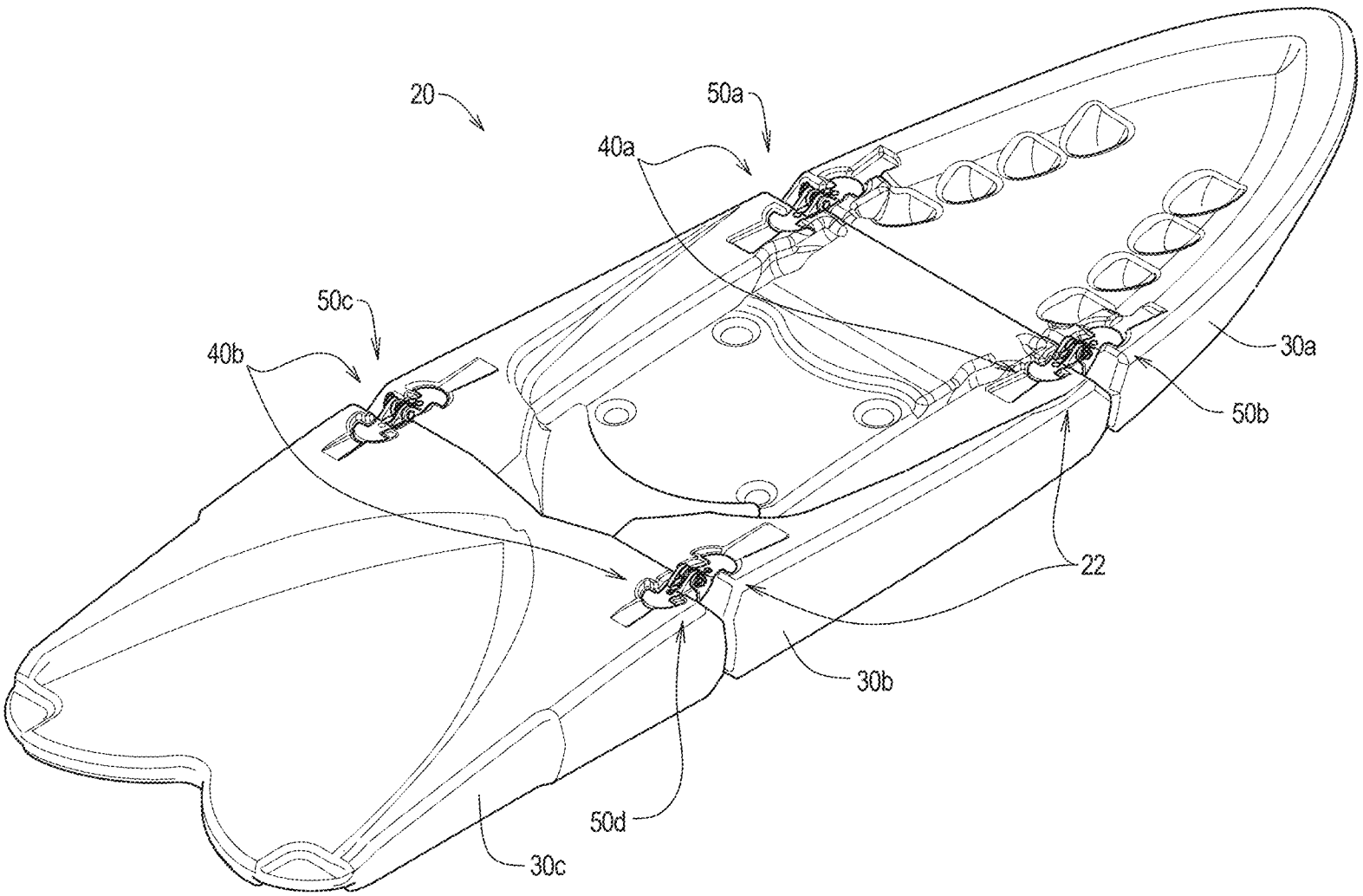
FIG. 1 is a perspective view of a first example reconfigurable watercraft in a first configuration, the first reconfigurable watercraft comprising a plurality of hinge assemblies of the present invention.
Figure 2:
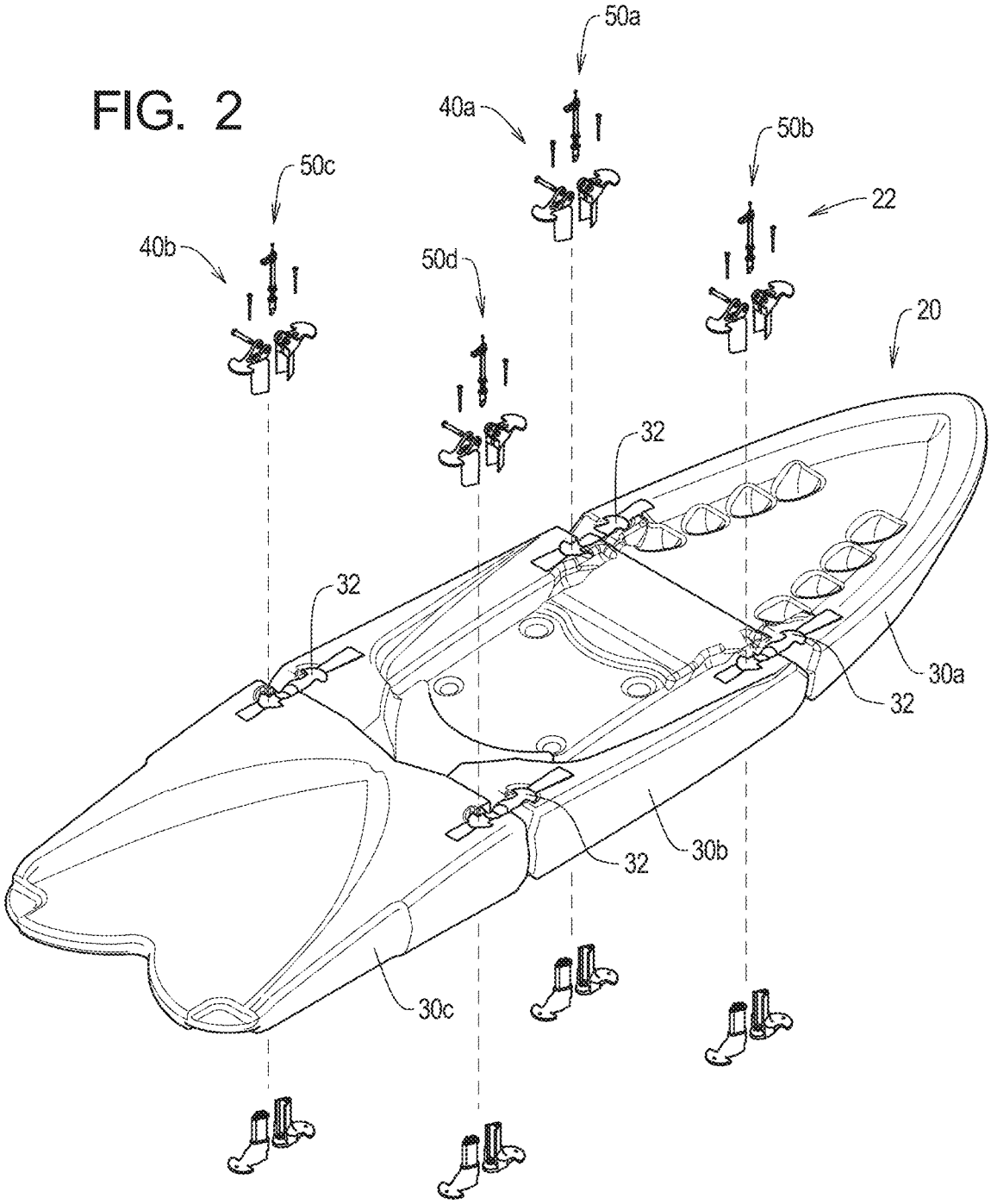
FIG. 2 is a perspective, exploded view of the first example reconfigurable watercraft in the first configuration.
Figure 7:
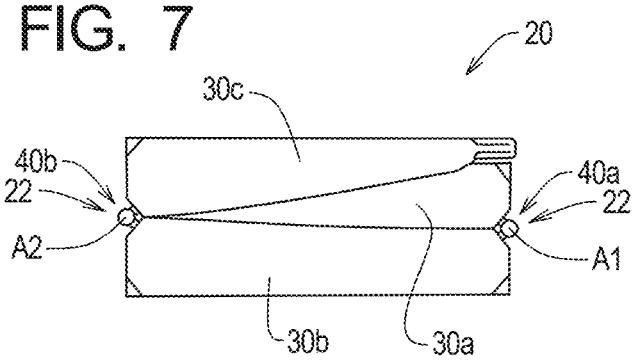

Referring initially to FIGS. 1 and 2 of the drawing, depicted therein is a first example watercraft 20 comprising a plurality (e.g., two or more) watercraft sections 30. Each watercraft section 30 defines at least one hinge recess 32. The example connecting system 22 allows the first example watercraft 20 to be configured between a first configuration (FIGS. 1 and 3) and a second configuration (FIG. 7). The example connecting system 22 comprises one or more hinge systems 40. Each of the example hinge systems 40 comprises one or more hinge assemblies 50.

Figure 8:
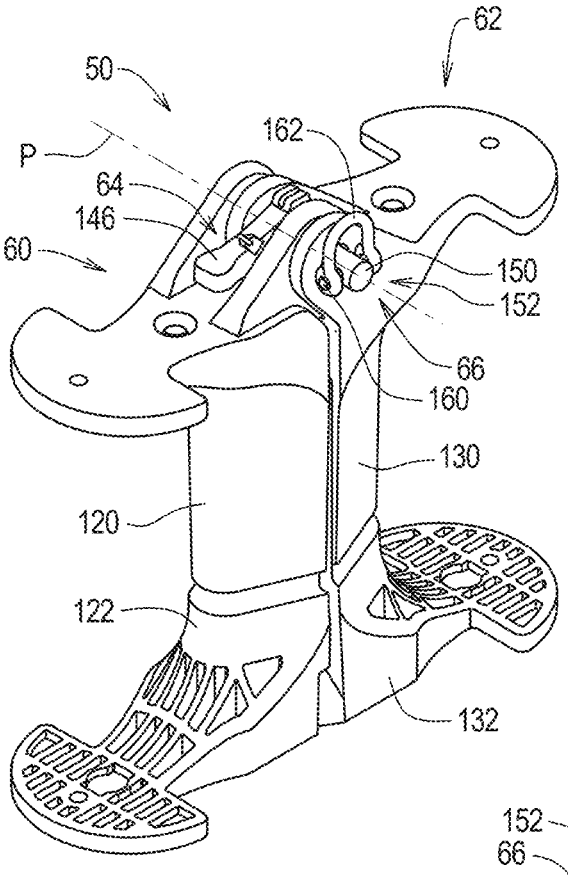
FIG. 8 is a perspective view of a first example hinge assembly of present invention.
Figure 9:
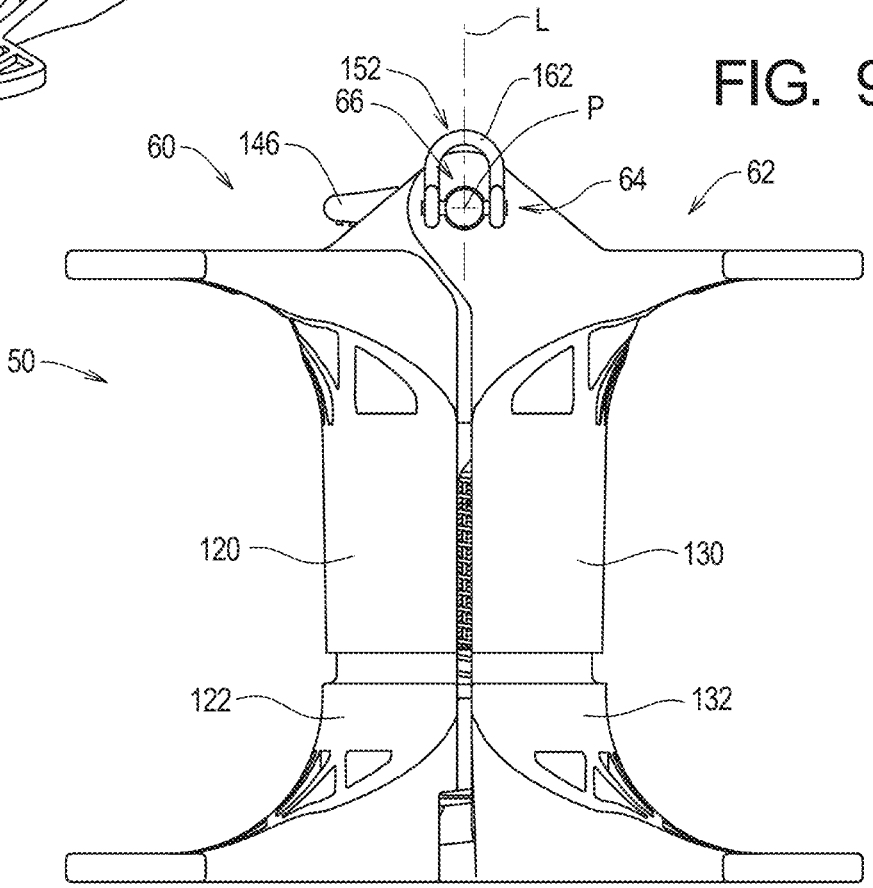
FIG. 9 is a front elevation view of first example hinge assembly of present invention.

FIGS. 8 and 9 of the drawing illustrate that the example hinge assemblies 50 each comprises a latch support assembly 60, a strike assembly 62, a latch system 64, and a pivot assembly 66. The pivot assembly 66 engages the latch support assembly 60 and the strike assembly 62 to allow the latch support assembly 60 and the strike assembly 62 to pivot relative to each other about a pivot axis P. The pivot axis P is typically substantially horizontal during normal use of the example hinge assemblies 50.

With the hinge assemblies 50 secured to the watercraft sections 30, the example latch system 64 is configurable in a latched configuration in which rotation of the example strike assembly 62 relative to the example latch support assembly 60 is inhibited and in an unlatched configuration in which the example strike assembly 62 may be rotated relative to the example latch support assembly 60. In particular, the latch system 64 is in the latched configuration when the first example watercraft 20 is in the first configuration and in the unlatched configuration when the first example watercraft 20 is in the second configuration. The latch system 64 is further manually reconfigured from the latched configuration to the unlatched configuration to allow the first example watercraft 20 to be reconfigured from the first configuration to the second configuration. During use of the first example watercraft 20, the example latch system 64 is automatically reconfigured from the unlatched configuration to a pre-latched configuration when the first example watercraft 20 is reconfigured from the first configuration to the second configuration. The example latch system 64 is further automatically reconfigured from the pre-latched configuration to the latched configuration when the first example watercraft 20 is reconfigured from the second configuration to the first configuration.

The example connection system 22 comprising the example hinge assemblies 50 thus pivotably connects the watercraft sections 30 to each other, automatically lock the first example watercraft 20 in the first configuration, and allow the first example watercraft 20 to be reconfigured from the first configuration to the second configuration when in the unlatched and pre-latched configurations with minimal user interaction with the hinge assemblies 50.

The construction and operation of the first example watercraft will now be described in further detail with reference to FIGS. 10-17E. In the following discussion, reference characters without letter suffixes and reference characters with letter suffixes typically, but not necessarily, refer to elements of the same type.

Figure 3:
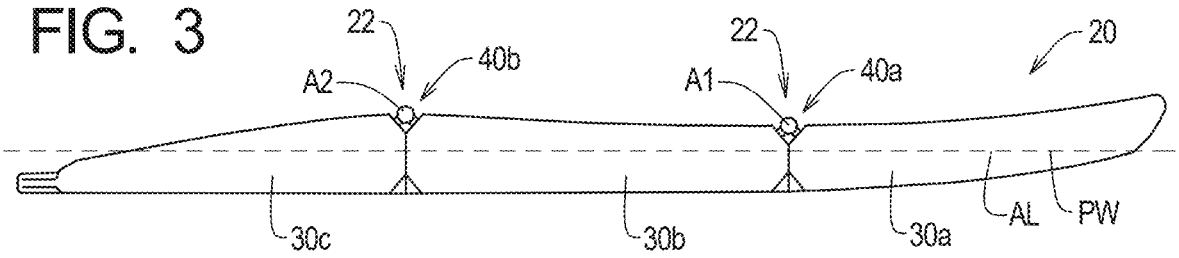
FIGS. 3-7 are side elevation views illustrating reconfiguration of the first example reconfigurable watercraft of the present invention from the first configuration into a second configuration.
Figure 4:
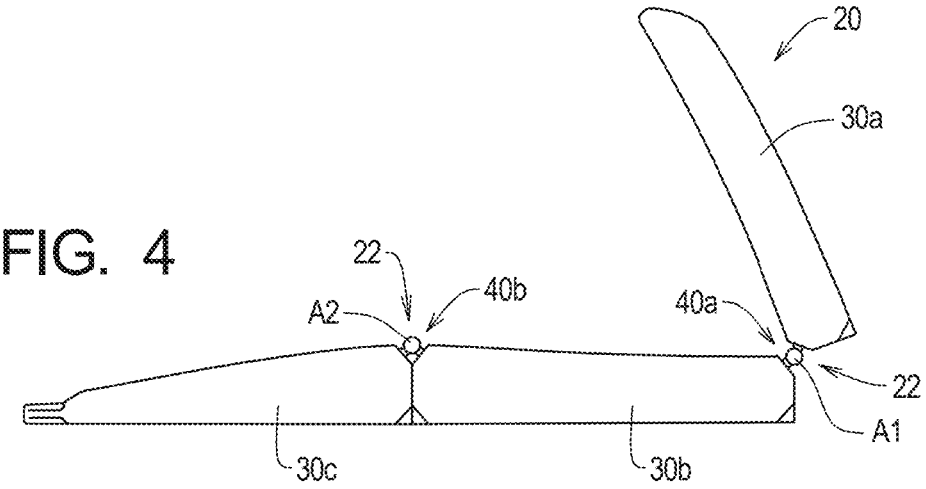
Figure 5:
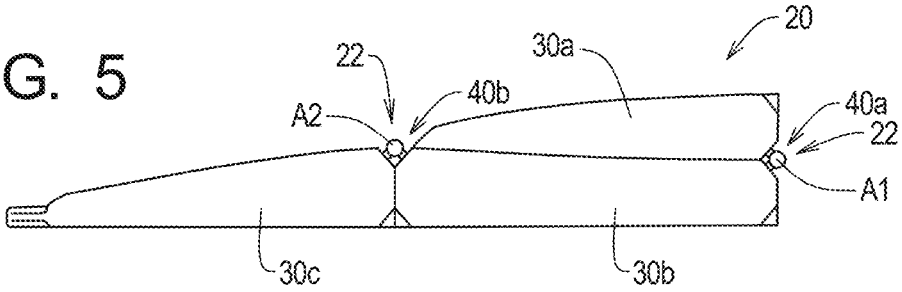
Figure 6:
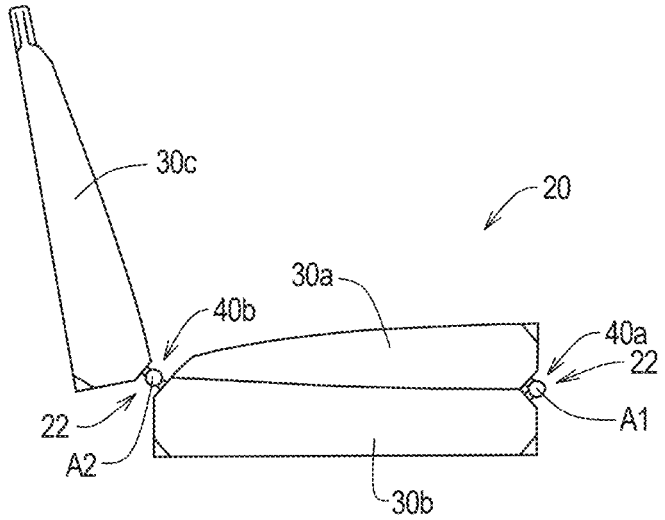

As perhaps best shown in FIG. 3, when in the first configuration the first example watercraft 20 defines a watercraft longitudinal axis AL. A watercraft reference plane PW extends through the watercraft longitudinal axis AL and is perpendicular to the page in FIG. 3.

FIGS. 1-7 further illustrate that that the example watercraft 20 comprises three of the watercraft sections 30: a bow section 30*a*, an intermediate section 30*b*, and a stern section 30*c*.

FIGS. 3-7 illustrate that the first example water craft may be reconfigured between the first configuration (FIGS. 1 and 3) in which the first and second hinge systems 40*a* and 40*b* secure the bow, intermediate, and stern sections 30*a*, 30*b*, and 30*c* together during conventional use of the first example watercraft 20 and the second configuration (FIG. 7) to facilitate storage and transportation of the first example watercraft 20 when not in use. In particular, the example first hinge system 40*a* pivotably connects the bow and intermediate sections 30*a* and 30*b* for rotation about a first main axis A1, while the example second hinge system 40*b* joins the intermediate and stern sections 30*b* and 30*c* for rotation about a second main axis A2. Further, each hinge assembly 50 is adapted to engage a first pair of the hinge recesses 32 on one of the watercraft sections 30*a*, 30*b*, and 30*c* and a second pair of hinge recesses 32 on another of the watercraft sections 30*a*, 30*b*, and 30*c*.

In the first example watercraft 20, the first example hinge system 40*a* comprises a first hinge assembly 50*a* and a second hinge assembly 50*b*, while the second example hinge system 40*b* comprises a third hinge assembly 50*c* and a fourth hinge assembly 50*d*. The example first and second hinge assemblies 50*a* and 50*b* are connected to the bow and intermediate sections 30*a* and 30*b*, while the example third and fourth hinge assemblies 50*c* and 50*d* are connected to the intermediate and stern sections 30*b* and 30*c*. The example hinge assemblies 50*a*, 50*b*, 50*c*, and 50*d* are all identical; however, the hinge assemblies 50*a*, 50*b*, 50*c*, and 50*d* need not be identical.

FIG. 2 illustrates that at least one, and in the example watercraft 20 two, of the hinge recesses 32 are formed on the upper surface of each of the watercraft section 30. Not visible in FIG. 2 is at least one hinge recess 32 formed on bottom surface of each of the watercraft sections 30. More specifically, in the example watercraft 20 each of the hinge recesses 32 formed on the upper surface of the watercraft sections 30*a*, 30*b*, and 30*c* has a corresponding hinge recess 32 on the lower surface of each watercraft sections 30. Each of the example hinge assemblies 50 is configured to engage one of the hinge recesses 32 formed on the upper surface of the watercraft sections 30 and the corresponding hinge recess 32 formed on the lower surface of the watercraft sections 30 as will be described in further detail below.

Figure 10:
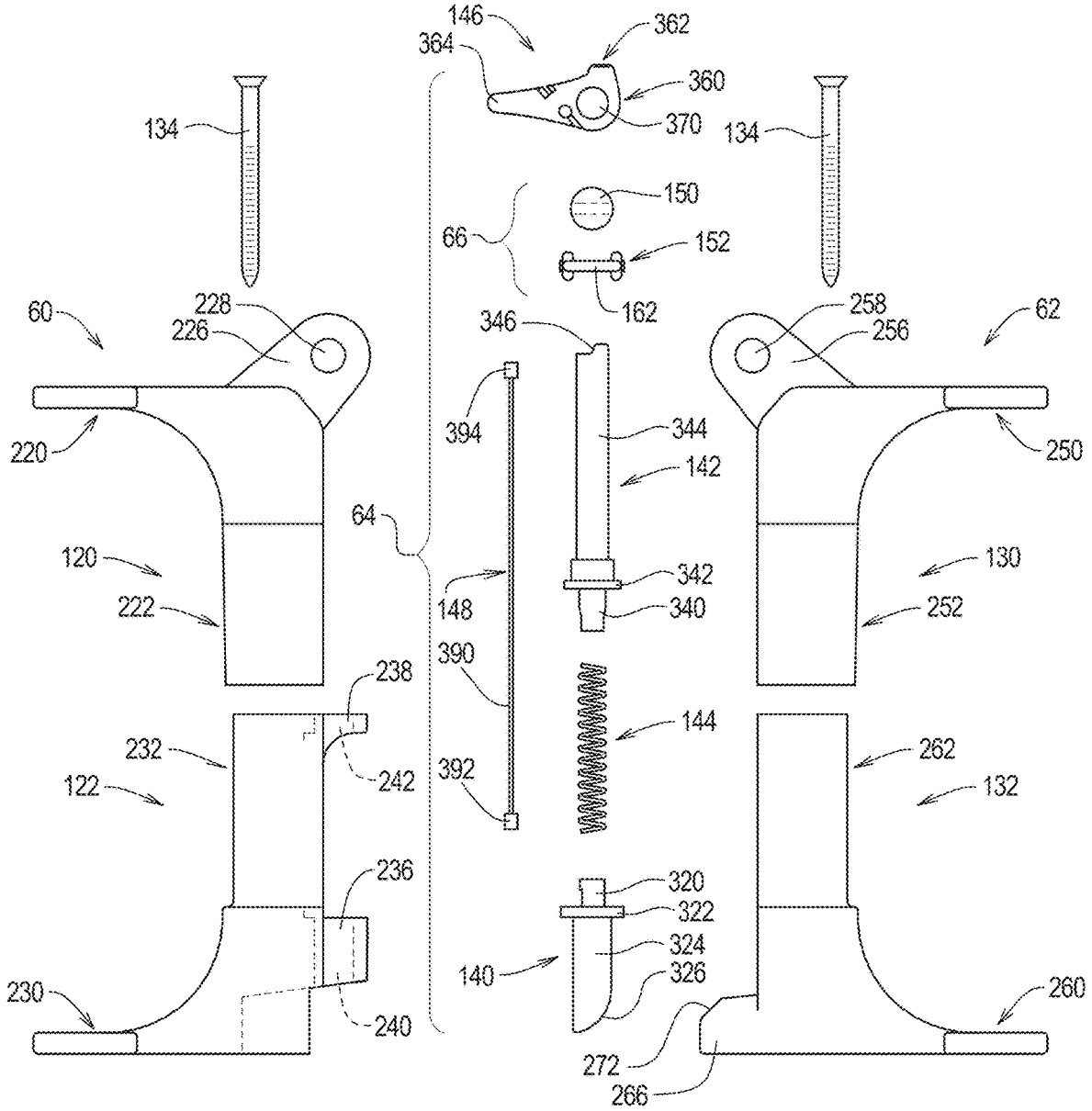
FIG. 10 is a side elevation, exploded view of the first example hinge assembly.

Turning now to FIG. 10 of the drawing, the latch support assembly 60, the striker assembly 62, the latch system 64, and the pivot assembly 66 of the example hinge assembly 50 will be described in further detail.

The example latch support assembly 60 comprises first and second latch support members 120 and 122 and at least one latch support fastener 124. The example striker assembly 62 comprises first and second striker members 130 and 132 and at least one striker fastener 134.

The example latch system 64 comprises a latch member 140, a latch pin 142, a latch return member 144, a release member 146, and a latch cord assembly 148.

The example pivot assembly 66 comprises a pivot member 150 and a pivot retainer assembly 152. The example pivot retainer assembly 152 is or may be conventional and comprises a retainer pin 160 and a retainer clip 162.

Figure 17A:
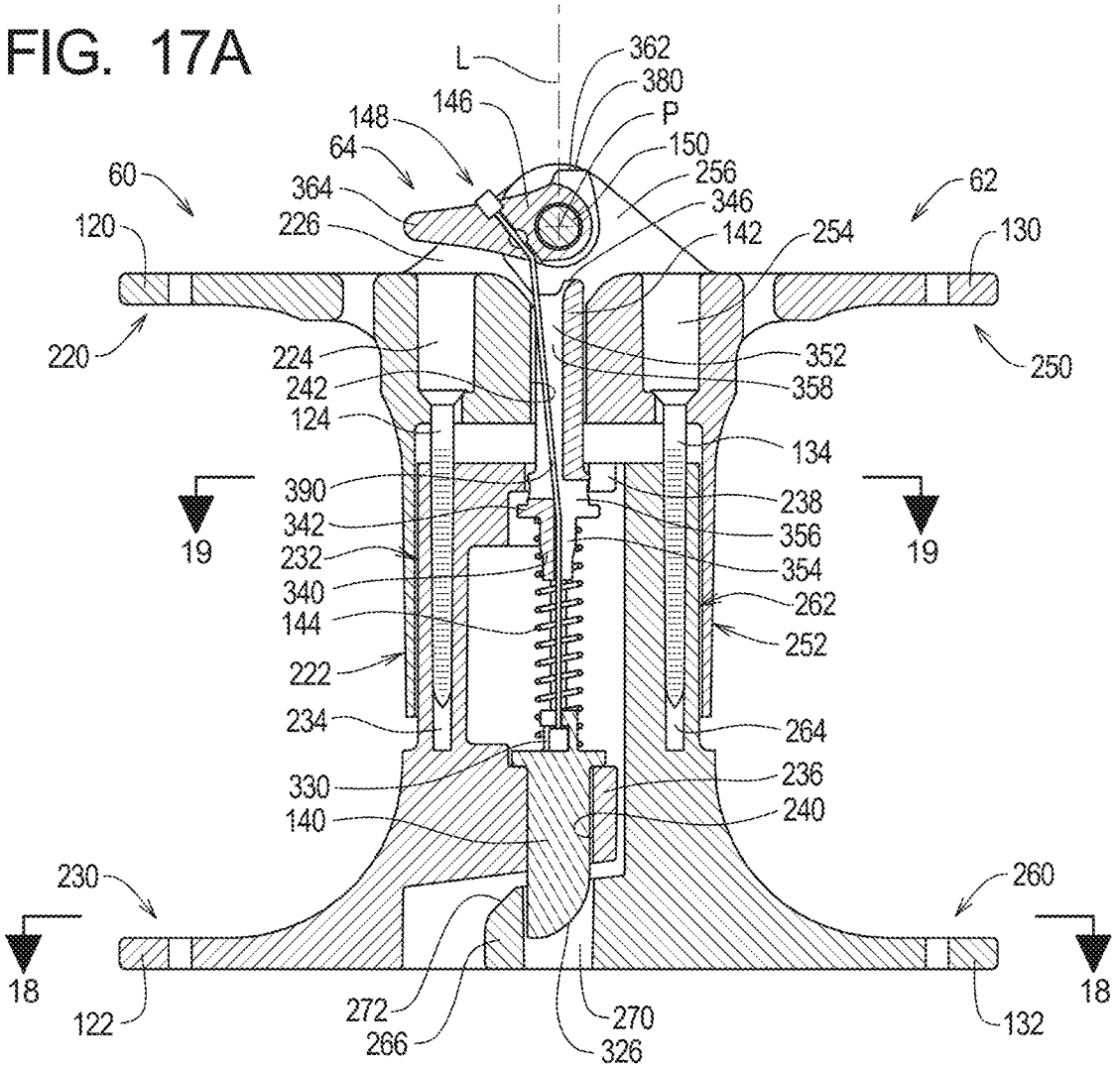
FIG. 17A is a section view taken along lines 17A-17A in FIG. 15.
Figure 19:
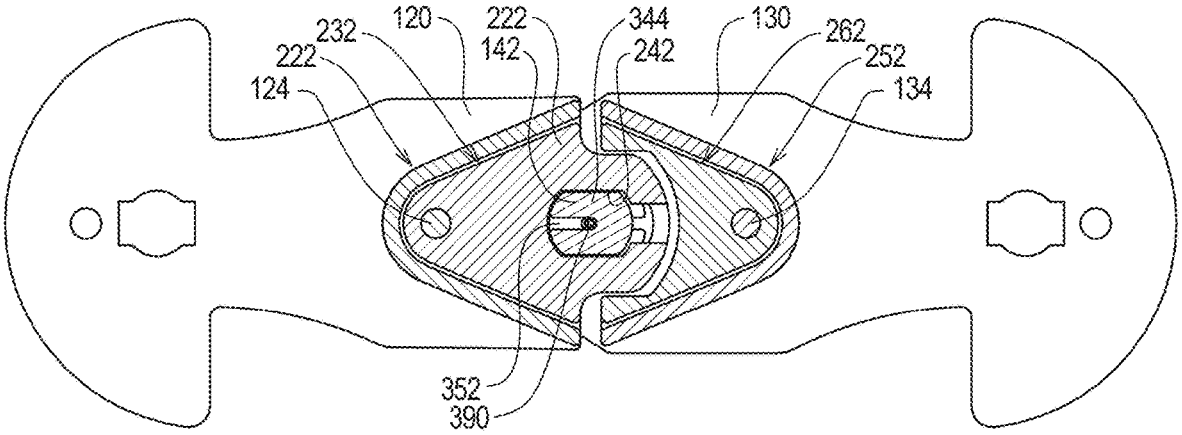
FIG. 19 is a section view taken along lines 19-19 in FIG. 17A.

The example first latch support member 120 defines a first key portion 220, first engaging portion 222, a latch connecting passageway 224, and at least one latch pivot projection 226 defining a latch pivot opening 228. The example second latch support member 122 defines a second key portion 230, a second engaging portion 232, a latch connecting cavity 234, a latch support projection 236, and a pin support projection 238. The example latch support projection 236 defines a latch support passageway 240 (FIG. 17A), and the example pin support projection 238 defines a pin guide groove 242 (FIGS. 17A and 19).

The example first and second key portions 220 and 230 are adapted to engage corresponding key recesses 32 in the outer surfaces of the watercraft sections 30 (FIG. 2). In the example latch support assembly 60, the example first and second latch members 120 and 122 are arranged such that the example key portions 220 and 230 are within a pair of opposing key recesses 32 and the first engaging portion 222 receives or otherwise engages the second engaging portion 232. So arranged, the latch support fastener(s) 124 are extended through the connecting passageway 224 to engage the latch connecting cavity 234 and thereby inhibit movement of first and second latch support members 120 and 122 relative to each other. Further, with the latch support fastener (s) 124 securely connecting the first and second latch support members 120 and 122, a portion of one of the watercraft sections 30 is arranged between the key portions 220 and 230. With the example latch support fastener(s) 124 tightened, movement of the first and second latch members 120 and 122 relative to each other and the corresponding watercraft section 30 is thus prevented during normal use of the watercraft 20.

The example first striker member 130 defines a third key portion 250, third engaging portion 252, a second connecting passageway 254, and at least one striker pivot projection 256 defining a striker pivot opening 258. The example second striker member 132 defines a fourth key portion 260, a fourth engaging portion 262, a second connecting cavity 264, and a striker receiving projection 266. The example striker receiving projection 266 defines a striker receiving passageway 270 and a striker engaging surface 272.

Like the first and second key portions 220 and 230, the example third and fourth key portions 250 and 260 are adapted to engage corresponding key recesses 32 in the outer surfaces of the watercraft sections 30. In the example striker assembly 62, the example first and second striker members 130 and 132 are arranged such that the example key portions 250 and 260 are within a pair of opposing key recesses 32 and the third engaging portion 252 receives or otherwise engages the fourth engaging portion 362. So arranged, the striker support fastener(s) 134 are extended through the second connecting passageway 254 to engage the second connecting cavity 264 and thereby inhibit movement of first and second striker members 130 and 132 relative to each other. Further, with the striker support fastener(s) 134 securely connecting the first and second striker members 130 and 132, a portion of one of the watercraft sections 30 is arranged between the key portions 250 and 260. With the example striker support fastener(s) 134 tightened, movement of the first and second striker members 130 and 132 relative to each other and the corresponding watercraft section 30 is thus prevented during normal use of the watercraft 20.

Figure 11A:
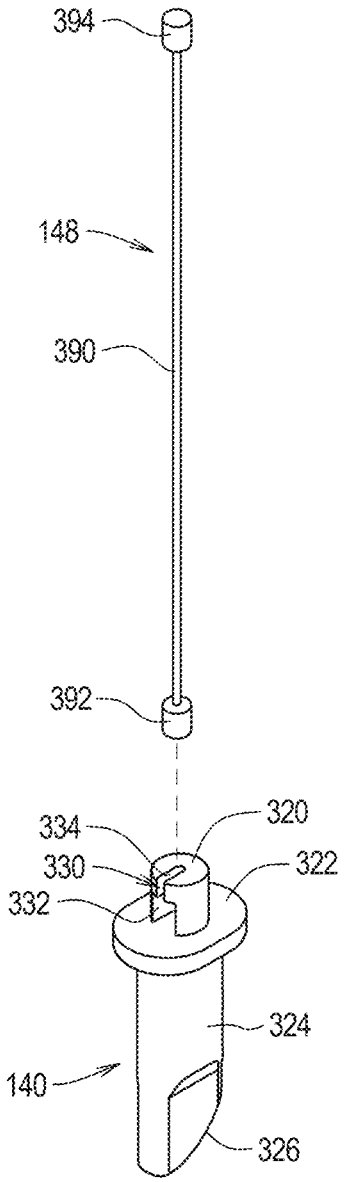
FIGS. 11A-11J are perspective views of illustrating assembly of a first example latch assembly used by the first example hinge assembly.

As perhaps best shown in FIG. 11A, the example latch member 140 comprises a first cord engaging portion 320, a latch collar 322, and a latch portion 324 defining a latch engaging surface 326. The example first cord engaging portion 320 defines a latch member cord slot 330 having first and second latch member cord slot portions 332 and 334.

Figure 11B:
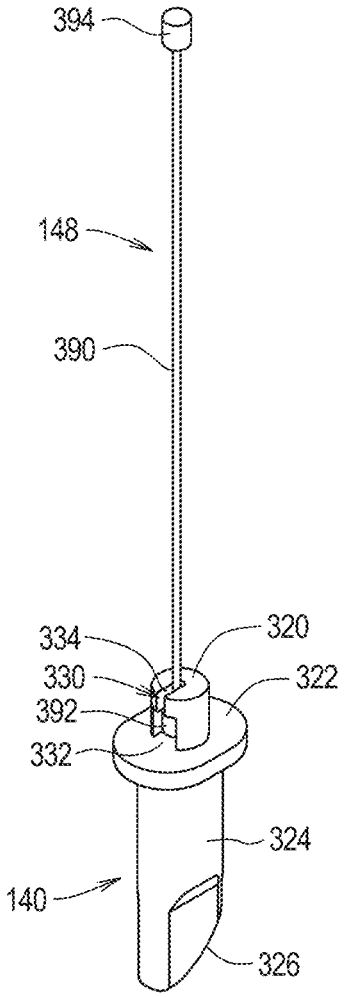
Figure 11C:
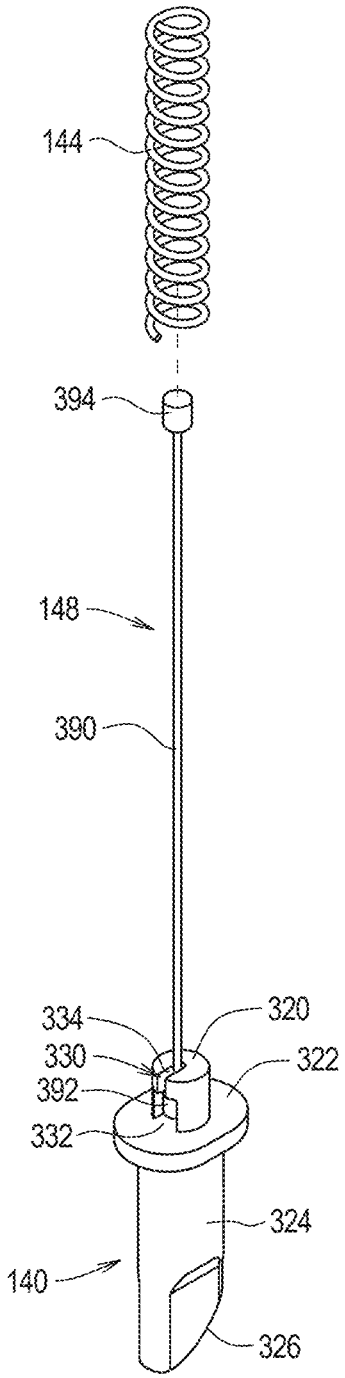
Figure 11D:
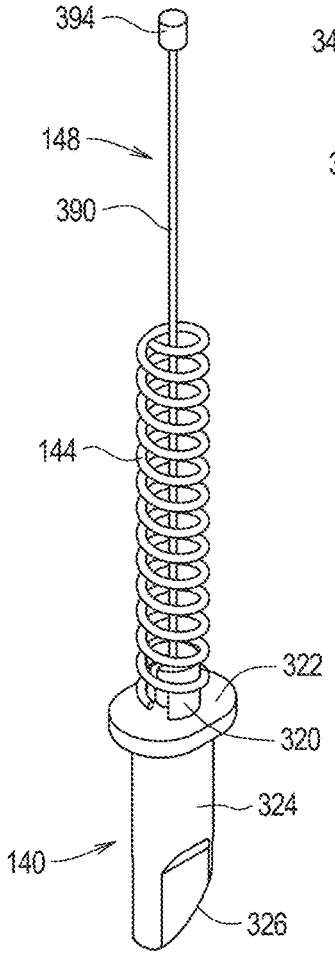
Figure 11E:
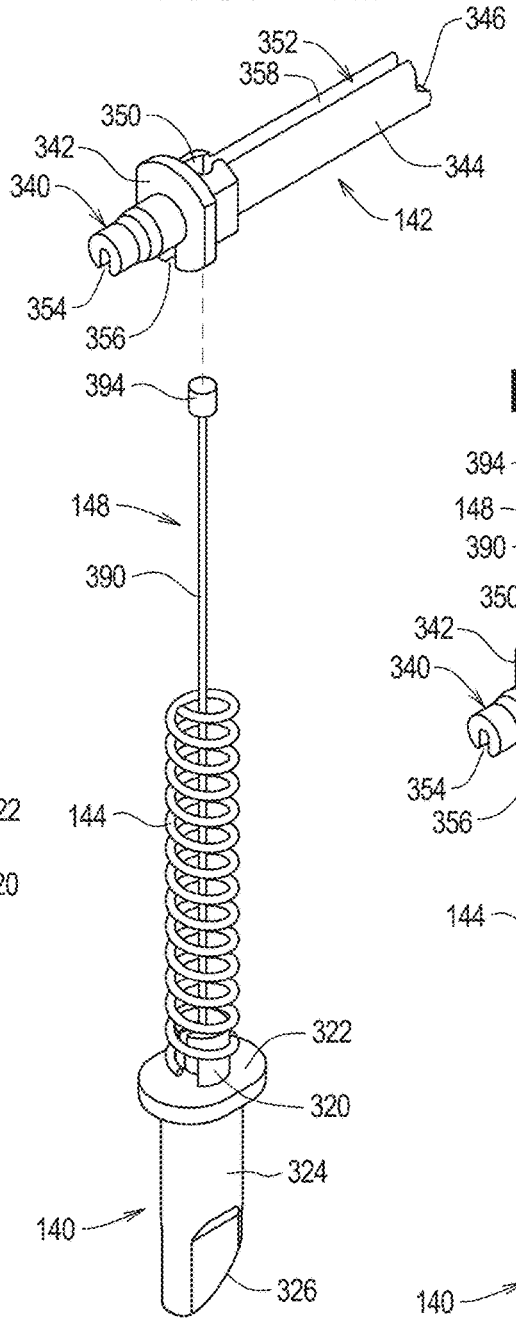
Figure 11F:
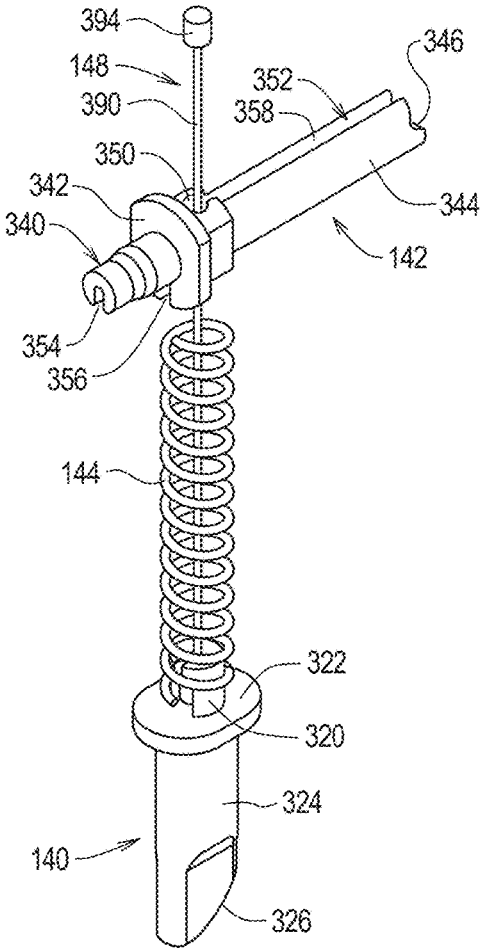
Figure 11G:
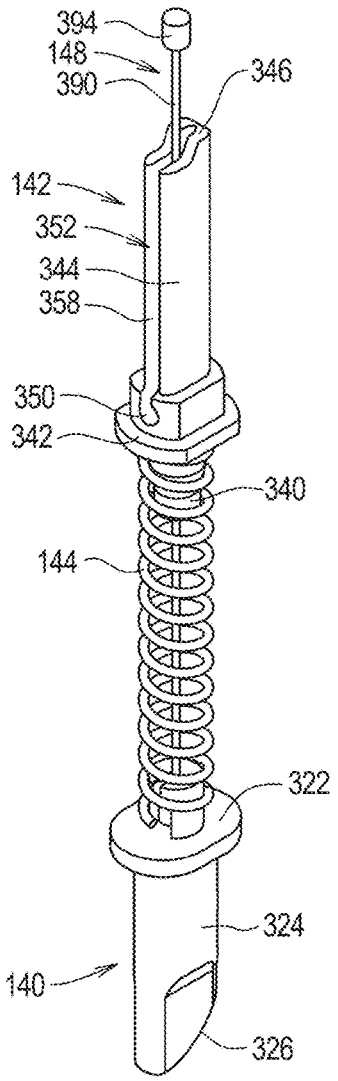
Figure 11H:
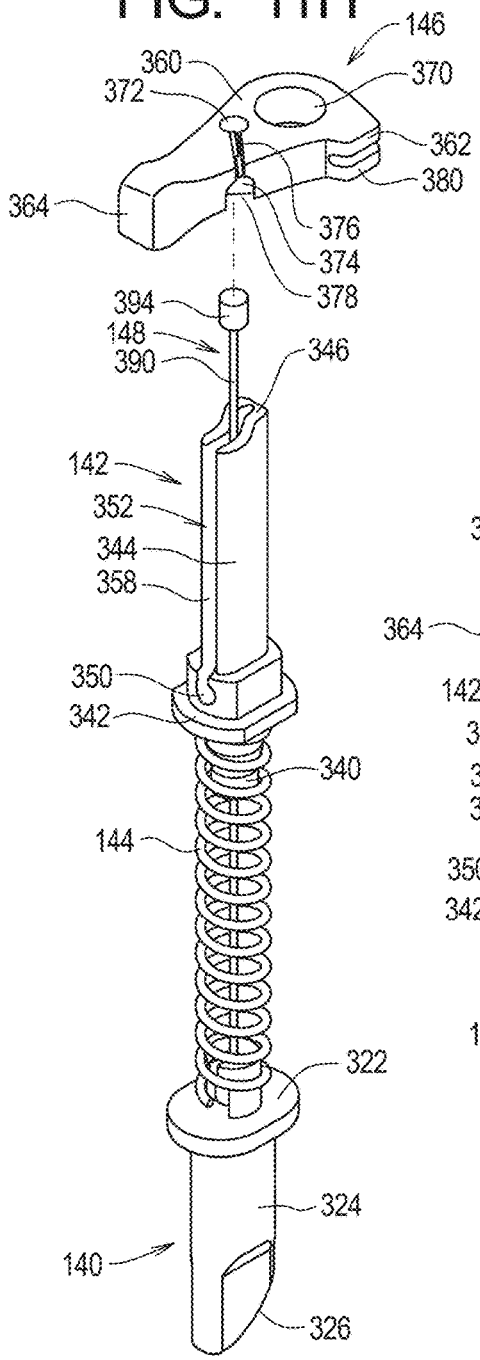
Figure 11I:
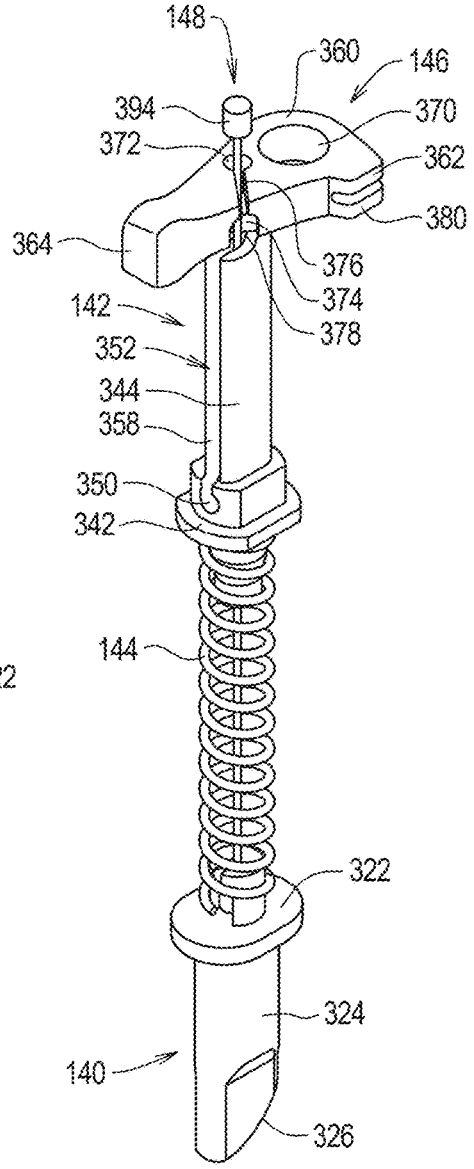

As perhaps best shown in FIGS. 11F and 11G, the example latch pin 142 comprises a return member engaging portion 340, a pin collar 342, and a latch pin shaft 344 defining a latch pin engaging surface 346. The example latch pin 142 further defines a cord through hole 350 and a latch pin cord passageway 352 having first, second, and third latch pin cord passageway portions 354, 356, and 358. The example first latch pin cord passageway portion 354 extends through the return member engaging portion 340. The example second latch pin cord passageway portion 356 extends through the pin collar 342. The example third latch pin cord passageway portion 358 extends through the latch pin shaft 344. The example cord through hole 350 intersects the third latch pin cord passageway portion 358 adjacent to the pin collar 342.

The example latch return member 144 is a helical compression spring adapted to be arranged between the latch member 140 and the latch pin 142. In particular, as perhaps best shown in FIG. 11G, a first end of the helical compression spring is sized and dimensioned to snugly receive the example first cord engaging portion 320 of the example latch member 140, and a second end of the helical compression spring is sized and dimensioned to snugly receive return member engaging portion 340 of the example latch pin 142.

Figure 12:
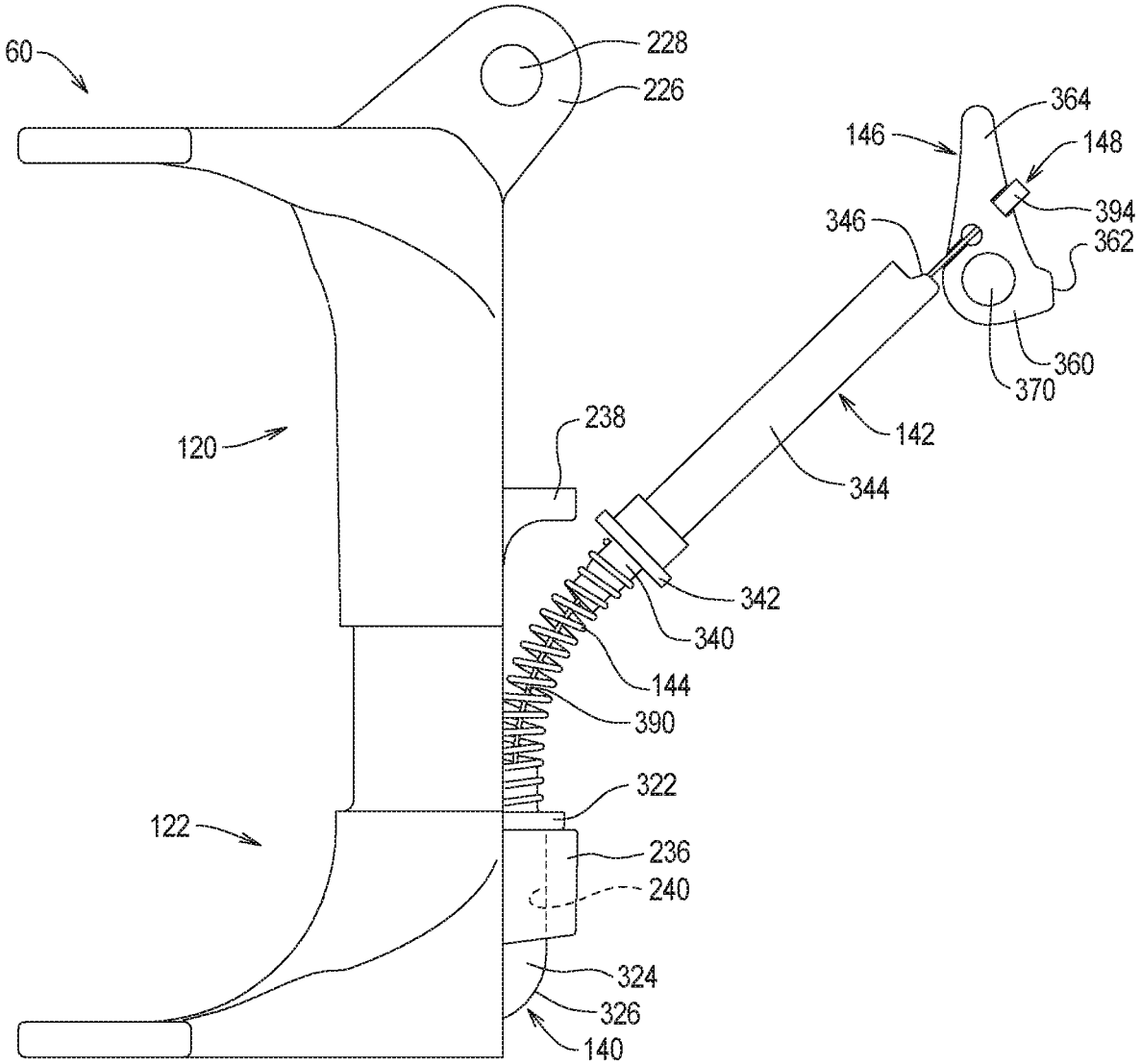
FIG. 12 is a side elevation view illustrating assembly of the first example latch assembly and a latch support assembly.

FIGS. 10 and 12 perhaps best illustrate that the example release member 146 comprises a central portion 360, a lock projection 362, and a handle projection 364. The example release member 146 further defines a release pivot opening 370, a cord through opening 372, and a cord side slot 374 formed in the central portion 360. The cord side slot 374 has a first side slot portion 376 and a second side slot portion 378. The example release member 146 further defines a latch pin engaging surface 380.

FIG. 11A illustrates that the example latch cord assembly 148 comprises a cord member 390, a first cord stop 392 secured to a first end of the cord member 390, and a second cord stop 394 secured to a second end of the cord member 390.

The assembly of the example latch system 64 will now be described with respect to FIGS. 11A-J of the drawing.

As shown in FIGS. 11A and 11B, the first end of the cord member 390 is first secured to the latch member 140. In particular, an effective cross-sectional area of the example first cord stop 392 is smaller than an effective cross-sectional area of the first latch member cord slot portion 332 and larger than an effective cross-sectional area of the first latch member cord slot portion 334. Accordingly, the first cord stop 392 may be arranged within the first latch member cord slot portion 332 of the latch member cord slot 330 but cannot pass through the second latch member cord slot portion 334. Therefore, with the first cord stop 392 arranged within the first latch member cord slot portion 332, the first end of the cord member 390 is securely held by the second latch member cord slot portion 334 when the second cord stop 394 and the latch member 140 are away from each other to place the cord member 390 under tension.

FIGS. 11C and 11D illustrate that, next, the second cord stop 394 arranged relative to the latch return member 144 until one end of the latch return member 144 engages the first cord engaging portion 320 of the example latch member 140. In the case of a latch return member formed by a helical compression spring, the second cord stop 394 is inserted through the helical compression spring.

Next, the latch pin 142 is connected to the subassembly formed by the latch member 140 and the latch cord assembly 148. In particular, the second cord stop 394 is displaced through the cord through hole 350 in the latch pin 142 as shown in FIGS. 11E and 11F. The latch pin 142 is then moved down the latch cord member 390 and rotated approximately 90 degrees until a portion of the latch cord member 390 resides in the latch pin cord passageway 352 and the return member engaging portion 340 of the latch pin 142 is in contact with the return member 144 as shown in FIG. 11G. At this point, the second cord stop 394 extends out of the latch pin cord passageway 352 beyond the latch pin engaging surface 346.

Figure 11J:
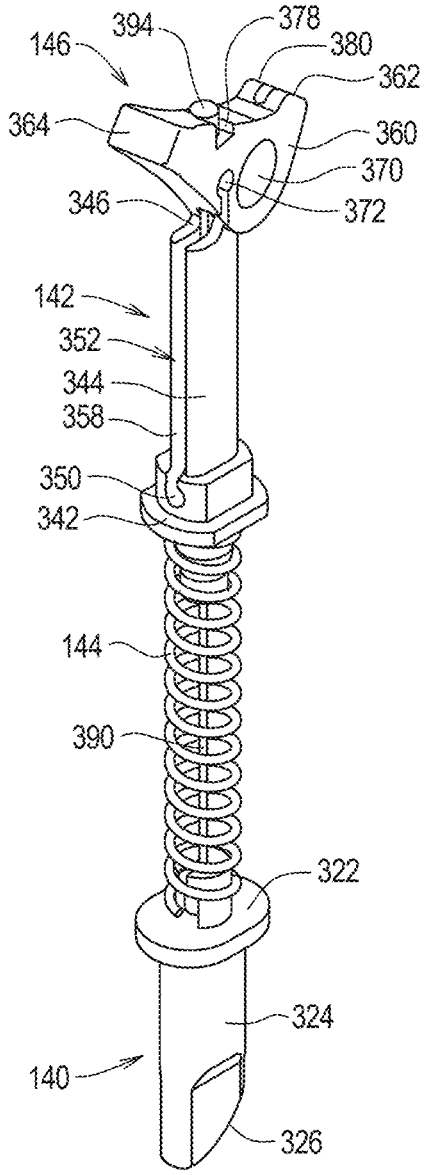

The release member 146 is next connected to the subassembly formed by the latch member 140, the latch pin 142, and the latch cord assembly 148. As shown in FIG. 111, the second cord stop 394 is first displaced through the cord through opening 372 formed in the release member 146 such that the second cord stop 394 is adjacent to the cord side slot 374. The release member 146 is next rotated approximately 90 degrees such that a portion of the cord member 390 is arranged within the first side slot portion 376 and the second cord stop 394 is arranged within the second side slot portion 378 as shown in FIG. 11J. At this point, the example latch system 64 is formed.

The example latch system 64 is next combined with the latch support assembly 60 assembled as described above. In particular, the latch system 64 is displaced such that, as shown in FIG. 12, a portion of the latch member 140 is arranged within the latch support passageway 240, the latch collar 322 engages the latch support projection 236, and the latch pin 142 is supported within the pin guide groove 242 with the pin collar 342 in contact with the pin support projection 238.

To complete formation of the hinge assembly 50, the striker assembly 62 and pivot assembly 66 are combined with the subassembly formed by the latch system 64 and the latch support assembly 60. In particular, the striker assembly 62 formed as described above is arranged such that the striker pivot opening 258 is substantially coaxially aligned with the latch pivot opening 228. The example release member 146 is next arranged such that the release pivot opening 370 is substantially coaxially aligned with the latch pivot opening 228 and the striker pivot opening 258. At this point, the example pivot member 150 is inserted through the aligned latch pivot opening 228, striker pivot opening 258, and release pivot opening 370 to pivotably connect the latch support assembly 60 to the striker assembly 62 for rotation about the latch pivot axis P. The pivot member 150 also supports the release member 146 of the latch system 64 for rotation between first and second angular positions about the pivot axis P. The pivot retainer assembly 152 is then arranged to inhibit removal of the example pivot member 150 from the pivot openings 228, 258, and 370. During normal use of the example hinge assembly 50, each of the latch pivot axes P is substantially aligned with one of the main pivot axes A.

Figure 13:
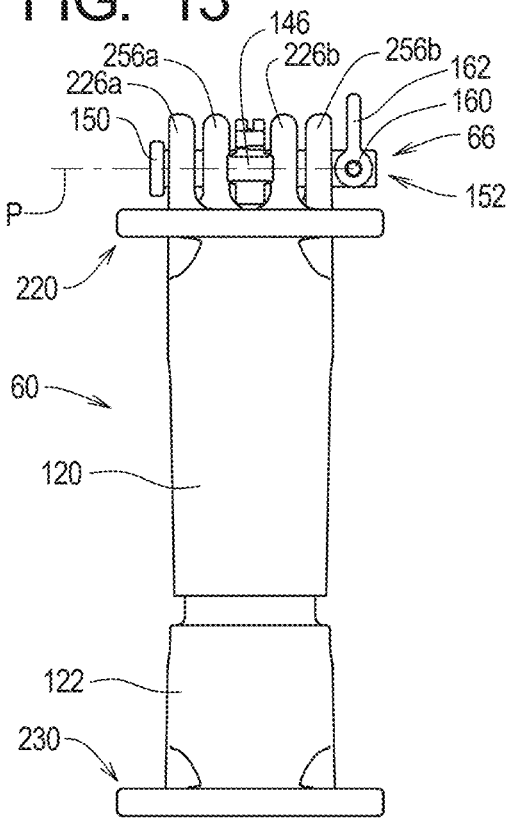
FIG. 13 is a first side elevation view of the first example hinge assembly.
Figure 14:
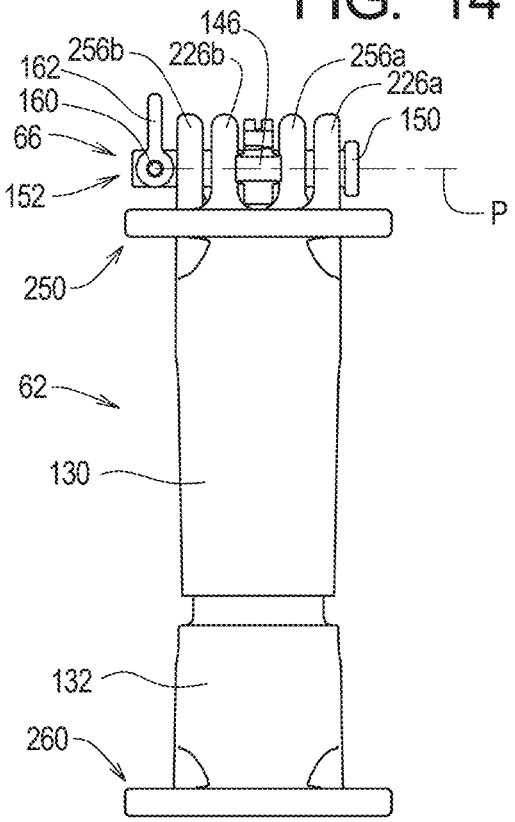
FIG. 14 is a second side elevation view of the first example hinge assembly.
Figure 15:
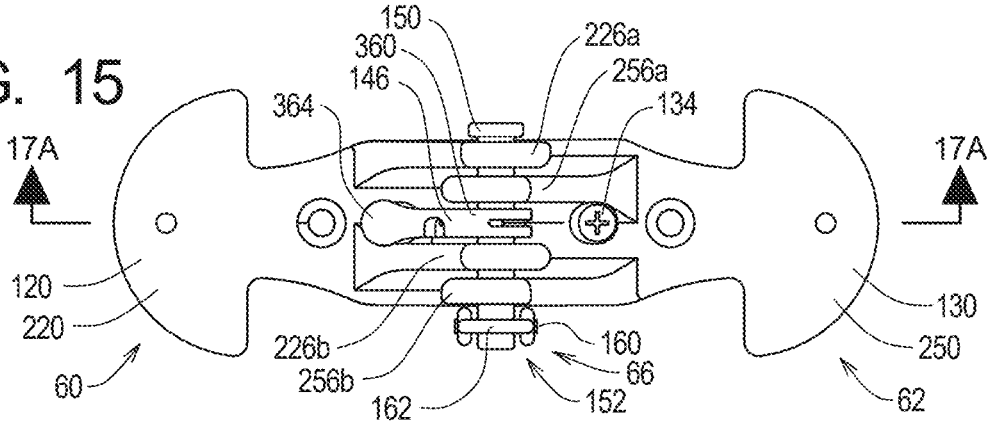
FIG. 15 is a top plan view of the first example hinge assembly.
Figure 16:
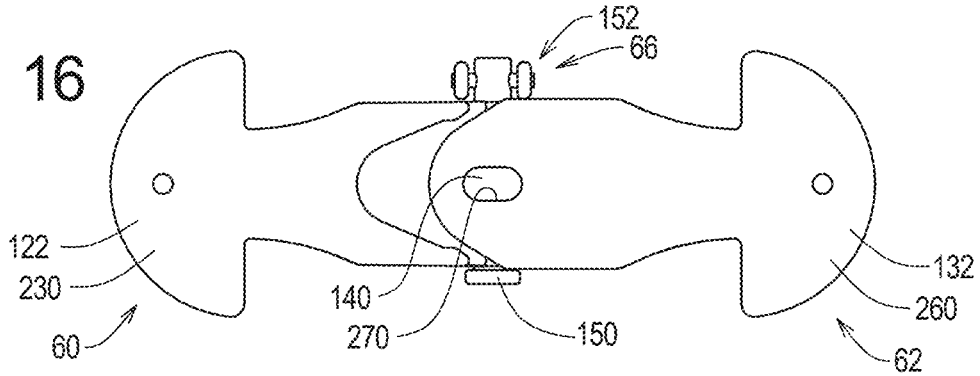
FIG. 16 is a bottom plan view of the first example hinge assembly.

As shown in FIGS. 13-15, the example release member 146 is between the at least one latch pivot projection 226 and the at least one striker pivot projection 256. More specifically, the example first latch support member 120 defines first and second latch pivot projections 226*a* and 226*b* and the example first striker member 130 defines first and second striker pivot projections 256*a* and 256*b*. The example release member 142 is arranged between the first latch pivot projection 236*a* and striker pivot projection 256*a* on one side and the second latch pivot projection 236*b* and striker pivot projection 256*b* on the other side.

With the latch system 64 supported by the latch support assembly 60 as depicted in FIGS. 17A-17E, the latch member 140 is supported for movement within a predetermined range along a latch axis L and the latch pin 142 is fixed relative to the latch axis L. At this point, the example hinge assembly 50 is formed. In addition, the latch member 140 may be moved between an extended position (FIGS. 17A, 17D, 17E) and a retracted position FIGS. 17B and 17C). During normal use of the example hinge assembly 50, the latch axis L is substantially vertical.

The use of the example hinge assembly 50 will now be described with reference to FIGS. 17A-17E. In general, the latch system 64 is configurable among a latched configuration (FIG. 17A), an unlatched configuration (FIGS. 17B and 17C), and a pre-latched configuration (FIGS. 17D and 17E). Further, the hinge assembly 50 is movable as shown in FIGS. 17C and 17E between an open configuration (FIGS. 17A and 17B) and a closed configuration (FIG. 17D). The watercraft sections 30 are not illustrated in FIGS. 17A-17E for purpose of clarity. However, with the latch support assembly 60 connected to one of the watercraft sections 30 and the striker support assembly 62 connected to another of the water craft sections 30 as described above, six of the example hinge assemblies 50 can be configured as shown in FIGS. 1 and 2 to allow the reconfiguration of the watercraft 20 as shown in FIGS. 3-7.

More specifically, when the latch assembly 64 is in the latched configuration and the hinge assembly 50 in the open configuration, the latch member 140 is biased by the latch return member 140 into the extended position and arranged partly within the striker receiving passageway 270 (FIGS. 17A and 19). With the latch member 140 within the striker receiving passageway 270, the latch member 140 engages the portion of the striker receiving projection 266 defining the striker receiving passageway 270 to limit rotational movement of the striker assembly 62 about the pivot axis P relative to the latch support assembly 60. When the latch system 64 is in the latched configuration, the striker assembly 62 is in the open configuration relative to the latch support assembly and the release member 146 is in the first angular position about the pivot axis P as shown in FIG. 17A.

Figure 17B:
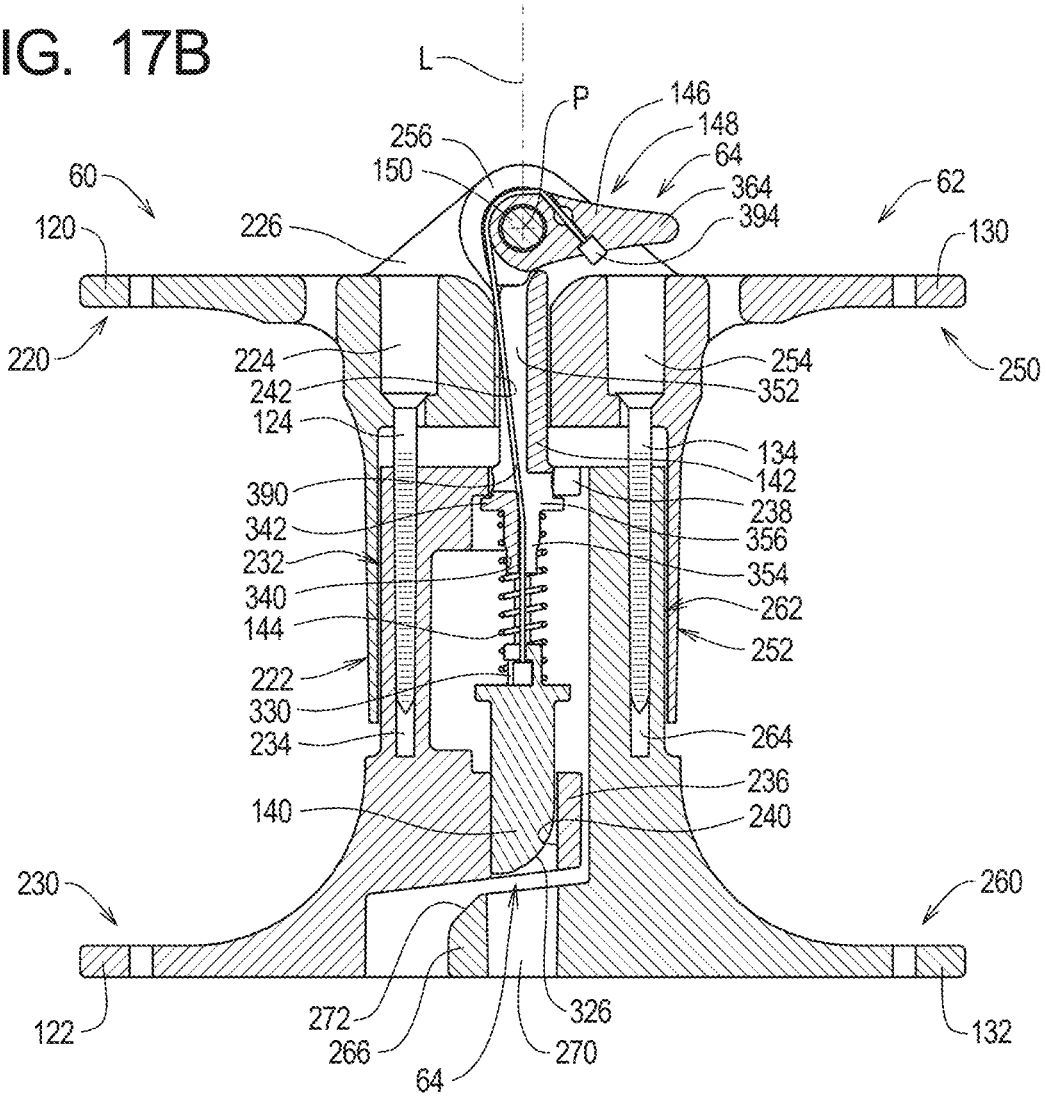
FIGS. 17B-17E are section views similar to the section view of FIG. 17A illustrating operation of the first example hinge assembly.
Figure 17C:
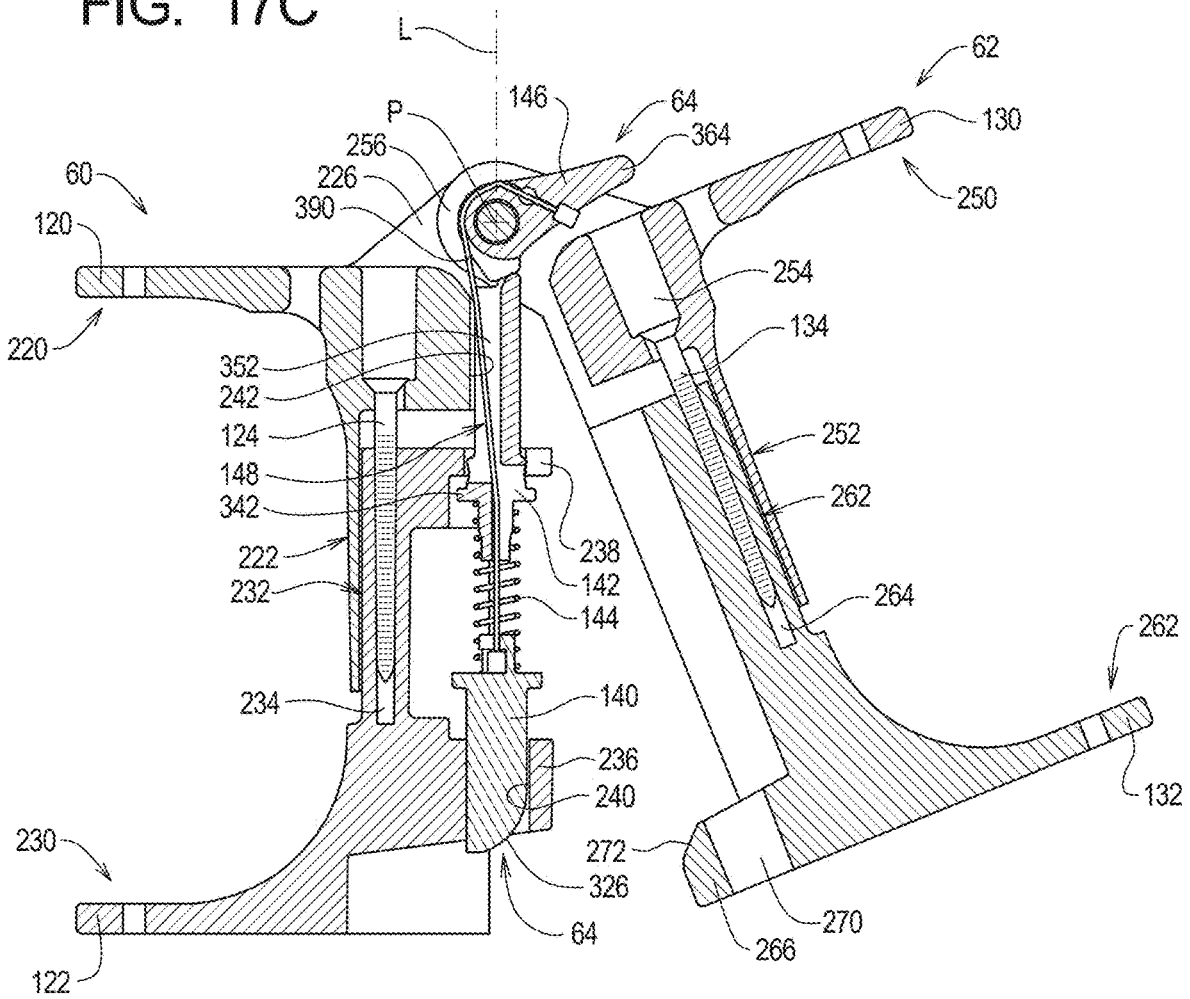
Figure 17D:
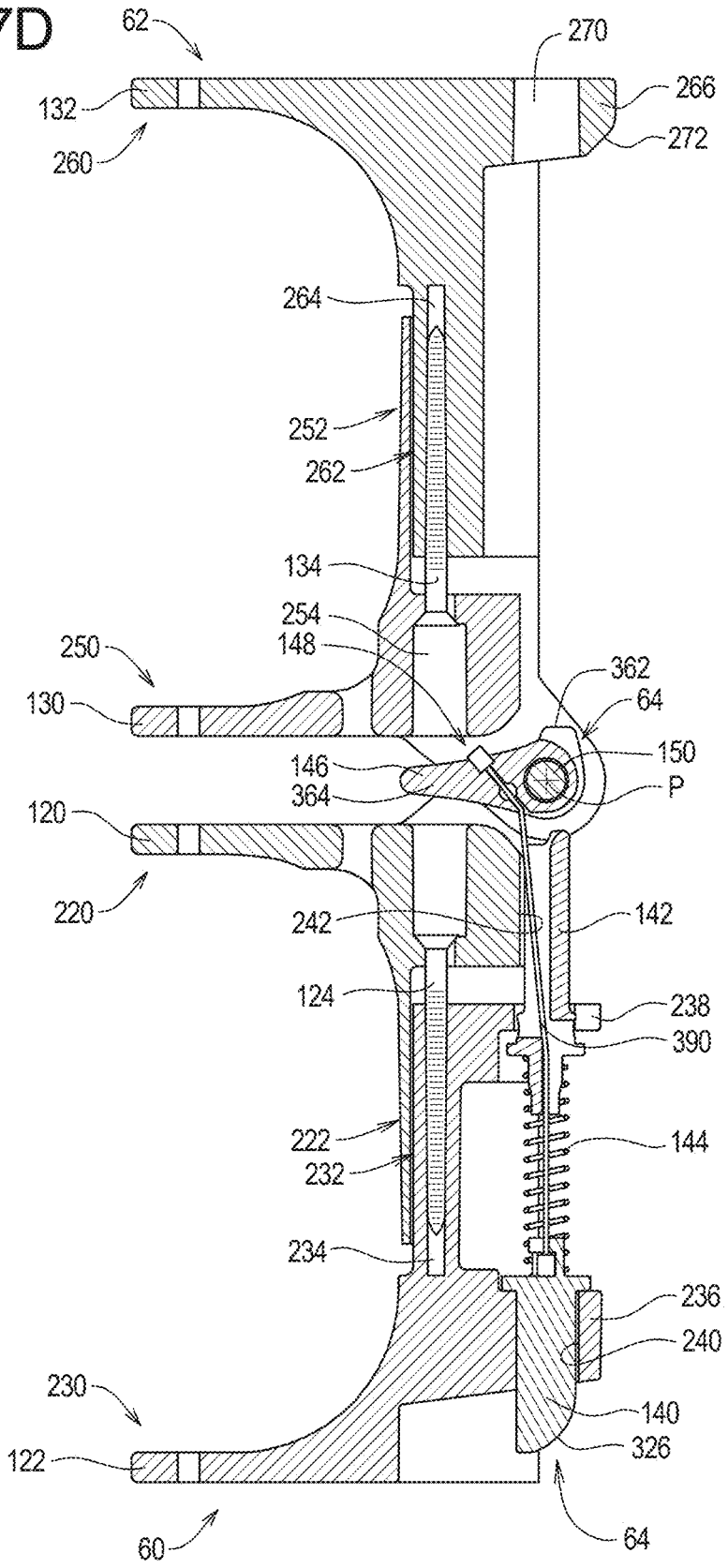
Figure 17E:
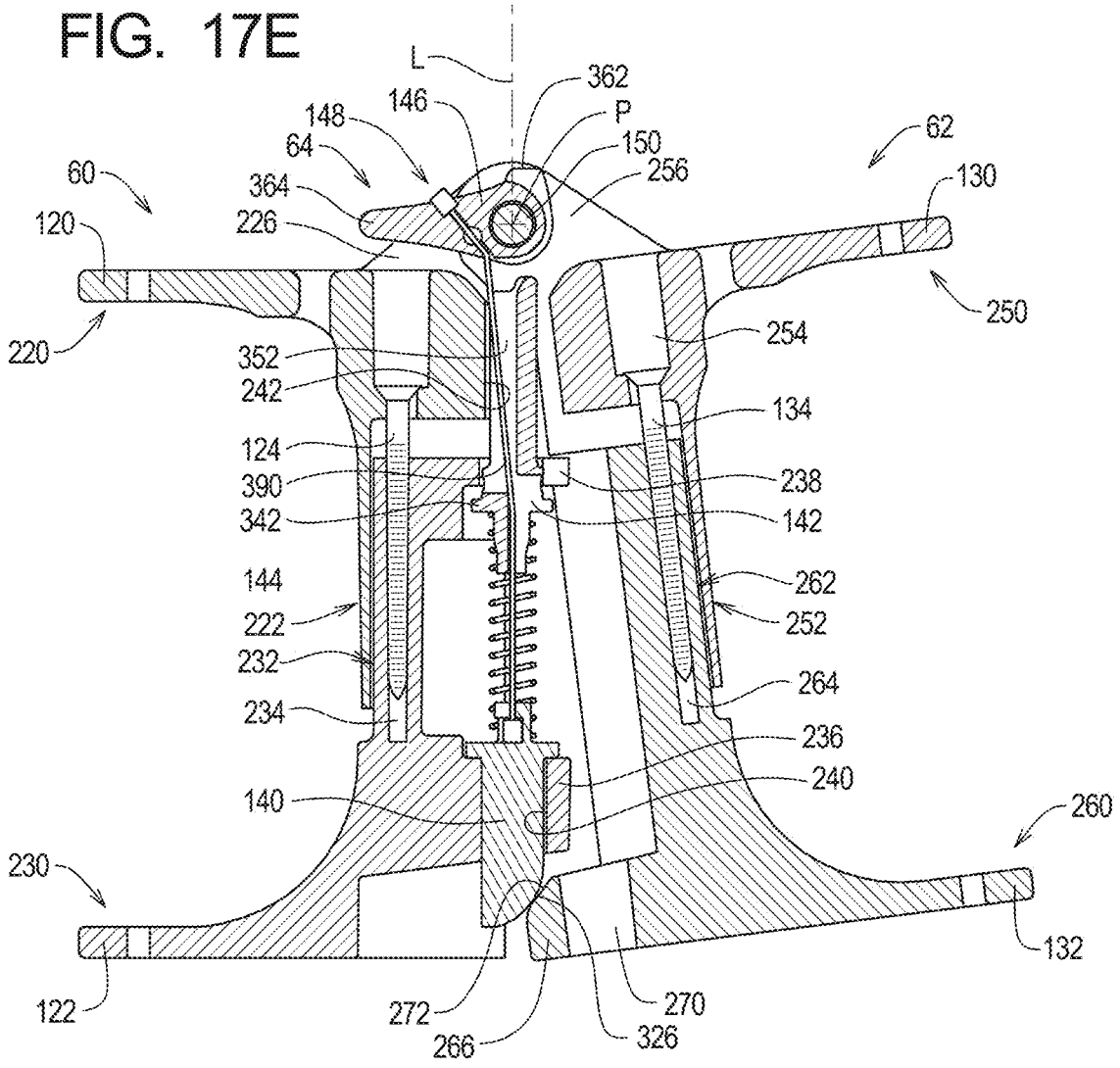
Figure 18:
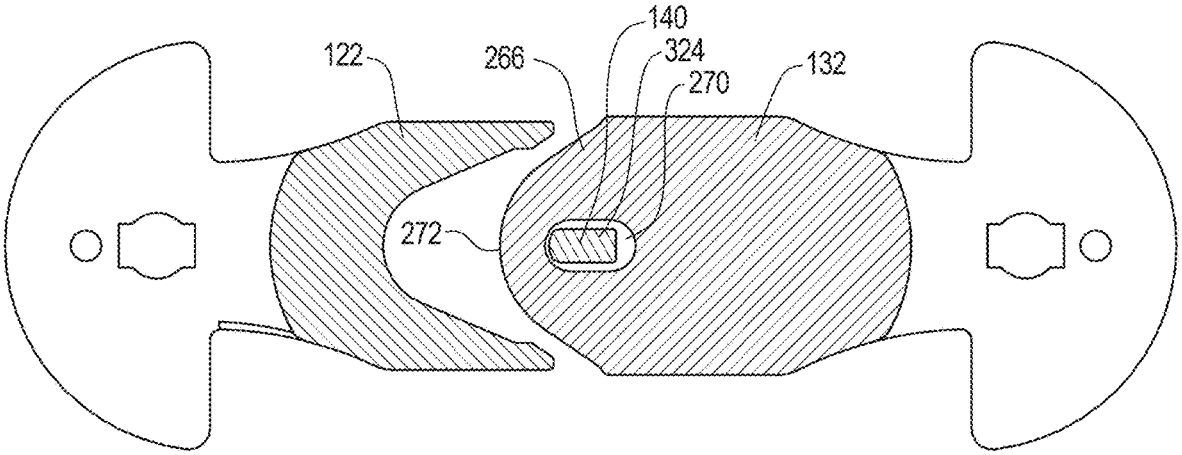
FIG. 18 is a section view taken along lines 18-18 in FIG. 17A.

To place the latch system 64 in the unlatched configuration, the release member 146 is manually rotated about the pivot axis P from the first angular position (FIG. 17A) to the second angular position (FIG. 17B). As the release member 146 is moved from the first angular position to the second angular position, the release member 146 acts on the latch member 140 through the latch cord assembly 148 to move the latch member 140 against the bias force of the latch return member 144 from the extended position into the retracted position as shown by a comparison of FIGS. 17A and 17B. The latch pin engaging surface 346 is contoured or shaped such that, when release member engaging surface 380 engages the latch pin engaging surface 346, the release member 146 is held in the second angular position. With the latch member 140 in the retracted position as shown in FIG. 17B, the latch member 140 is removed from the striker receiving passageway 270 such that the latch member 140 no longer engages the striker receiving projection 266. At this point, rotational movement of the striker assembly 62 about the pivot axis P relative to the latch support assembly 60 is allowed.

Accordingly, with the latch system 64 in the unlatched configuration, the striker assembly 62 may be rotated relative to the latch support assembly 60 from the open configuration as shown in FIG. 17C through an angle of approximately 180 degrees in a first pivot direction about the pivot axis P into the closed configuration as shown in FIG. 17D. As the striker assembly 62 rotates in the first pivot direction about the pivot axis P into the closed configuration, the striker assembly 62 acts on the release member 146 as shown in FIG. 17C to rotate the release member 146. The latch pin engaging surface 346 is additionally contoured or shaped such that, when the striker assembly 62 acts on and rotates the release member 146, the release member 146 is rotated from the from the second angular position (FIG. 17B) to the first angular position (FIG. 17D).

When the release member 146 is in the first angular position, tension on the latch rod assembly 148 is released, and the latch return member 144 biases the latch member 140 from the retracted position to the extended position to place the latch system 64 in the pre-latched configuration as shown in FIGS. 17D and 17E. When the latch system 64 is in the pre-latched configuration, the latch member 140 is in the extended position but is removed from the striker receiving passageway 270 such that rotational movement of the striker assembly 62 about the pivot axis P relative to the latch support assembly 60 is possible.

Accordingly, with the latch system 64 in the pre-latched configuration, the striker assembly 62 may be rotated relative to the latch support assembly 60 in a second pivot direction (opposite the first pivot direction) about the pivot axis P as shown in FIGS. 17D and 17E. FIG. 17E illustrates that, when the striker assembly 62 approaches the open configuration, the latch engaging surface 326 on the latch member 140 in the extended position engages the first latch engaging surface 272 on the second striker member 132. One or both of the first latch engaging surface 272 on the second striker member 132 and the second latch engaging surface 326 on the latch member 140 are shaped such that, when the surfaces 272 and 326 engage each other, rotational movement of the striker assembly 62 is translated into axial movement of the latch member 140 against the force of the latch return member 144.

Accordingly, continued rotation of the striker assembly 62 relative to the latch support assembly 60 forces the latch member 140 from the extended position into the retracted position. With the latch member 140 in the retracted position, further rotation of the striker assembly 62 relative to the latch support assembly 60 allows the striker receiving passageway 270 to align with the latch axis, at which point the latch return member 144 forces the latch member 140 back into the extended position and returns the latch system 64 to the latched configuration shown in FIG. 17A.

The first and second latch support members 120 and 122, the first and second striker members 130 and 132, the latch member 140, the latch pin 142, and the cord stops 392 and 394 may be inexpensively made of injection molded plastic. The fasteners 124 and 134, the latch return member 144, the pivot member 150, the pivot retainer assembly 152, and the cord member 390 all are or may be of-the-shelf parts that may be inexpensively sourced. The hinge assembly 50 can be assembled and disassembled without tools except for a driver to axially rotate the fasteners 124 and 134.

The hinge assembly 50 further may be cleaned of sand and other debris by pouring water through the hinge assembly downward along the latch axis L or by directing pressurized fluid such as air or water generally along the latch axis L. If further cleaning is required, the example hinge assembly 50 may be removed from the watercraft sections using only a screw driver and manually disassembled for cleaning. The example hinge assembly may thus be cleaned or even repaired or rebuilt in the field with only a screw driver.

Manufacture, maintenance, cleaning, and repair of the example hinge assembly 50 is thus simple and inexpensive.

What is claimed is:

1. A hinge assembly for use with a reconfigurable watercraft comprising at least first and second watercraft sections, the hinge assembly comprising:

a latch support member supported by the first watercraft section;

a striker member supported by the second watercraft section;

a pivot member arranged relative to the latch support member and the striker member such that the striker member may rotate about a pivot axis relative to the latch support member to allow the hinge assembly to be arranged in an open configuration and in a closed configuration; and a latch member supported by the latch support member for movement along a latch axis between a retracted position and an extended position; wherein when the hinge assembly is in the open configuration and the latch member is in the extended position, the striker member engages the latch member to inhibit movement of the hinge assembly from the open configuration to the closed configuration; and when the latch member is in the retracted position, the latch member is disengaged from the striker member such that the hinge assembly may be moved between the open configuration and the closed configuration.

2. The hinge assembly as recited in claim 1, further comprising at least one latch return member for biasing the latch member into the extended position.

3. The hinge assembly as recited in claim 1, further comprising at least one release member, where displacement of the release member displaces the latch member from the extended position to the closed position.

4. The hinge assembly as recited in claim 3, further comprising at least one cord member operatively connected between the release member and the latch member.

5. The hinge assembly as recited in claim 1, further comprising:

at least one latch return member for biasing the latch member into the extended position;

at least one release member; and at least one cord member; wherein the cord member is operatively connected between the release member and the latch member such that displacement of the release member displaces the latch member from the extended position to the closed position against the bias force applied by the latch return member.

6. The hinge assembly as recited in claim 1, in which:

the striker member defines a striker receiving passageway; wherein at least a portion of the latch member lies within the striker receiving passageway when the hinge assembly is in the open configuration and the latch member is in the extended position; and a portion of the striker member defining the striker receiving passageway engages the latch member to inhibit movement of the hinge assembly from the open configuration to the closed configuration.

7. The hinge assembly as recited in claim 1, in which:

the striker member defines a striker engaging surface; and the latch member defines a latch engaging surface; wherein when the hinge assembly is moved between from the closed configuration to the open configuration, the striker engaging surface engages the latch engaging surface to displace the latch member from the extended position to the closed position against the bias force applied by the latch return member.

8. A hinge assembly for use with a reconfigurable watercraft comprising at least first and second watercraft sections, the hinge assembly comprising:

a latch support assembly rigidly connected to the first watercraft section, the latch support assembly comprising a first latch support member and a second latch support member;

a striker assembly rigidly connected to the second watercraft section, the latch support assembly comprising a first striker member and a second striker member;

a pivot assembly comprising a pivot member pivotably connected to the first latch support member and the first striker member such that the striker assembly may rotate about a pivot axis relative to the latch support assembly to allow the hinge assembly to be arranged in an open configuration and in a closed configuration; and a latch assembly comprising a latch member, where the latch assembly is supported by the latch support assembly such that the latch member is movable along a latch axis between a retracted position and an extended position; wherein when the hinge assembly is in the open configuration and the latch member is in the extended position, the latch member engages the second striker member to inhibit movement of the hinge assembly from the open configuration to the closed configuration; and when the latch member is in the retracted position, the latch member is disengaged from the second striker member such that the hinge assembly may be moved between the open configuration and the closed configuration.

9. The hinge assembly as recited in claim 8, in which the latch assembly further comprises a latch return member for biasing the latch member into the extended position.

10. The hinge assembly as recited in claim 8, in which the latch assembly further comprises a release member, where displacement of the release member displaces latch member from the extended position to the closed position.

11. The hinge assembly as recited in claim 10, in which the latch assembly further comprises a cord member operatively connected between the release member and the latch member.

12. The hinge assembly as recited in claim 8, in which the latch assembly further comprises:

a latch return member for biasing the latch member into the extended position;

a release member; and a cord member; wherein the cord member is operatively connected between the release member and the latch member such that displacement of the release member displaces the latch member against the bias force applied by the latch return member from the extended position to the closed position.

13. The hinge assembly as recited in claim 8, in which:

the second striker member defines a striker receiving passageway;

wherein at least a portion of the latch member lies within the striker receiving passageway when the hinge assembly is in the open configuration and the latch member is in the extended position; and a portion of the second striker member defining the striker receiving passageway engages the latch member to inhibit movement of the hinge assembly from the open configuration to the closed configuration.

14. The hinge assembly as recited in claim 8, in which:

the second striker member defines a striker engaging surface; and the latch member defines a latch engaging surface; wherein when the hinge assembly is moved between from the closed configuration to the open configuration, the striker engaging surface engages the latch engaging surface to displace the latch member from the extended position to the closed position against the bias force applied by the latch return member.

* * * * *